United States Patent [19]

Bryant

[11] 3,954,383

[45] May 4, 1976

[54] BURNER CONTROL SYSTEM

[75] Inventor: Jack A. Bryant, Boston, Mass.

[73] Assignee: Electronics Corporation of America, Cambridge, Mass.

[22] Filed: Sept. 17, 1973

[21] Appl. No.: 397,640

[52] U.S. Cl. ..... 431/24; 251/131

[51] Int. Cl.[2] ..... F23N 5/24

[58] Field of Search ..... 431/15, 16, 24, 25, 431/26; 251/131

[56] References Cited

UNITED STATES PATENTS

| | | | |
|---|---|---|---|
| 3,202,976 | 8/1965 | Rowell | 431/24 |
| 3,324,927 | 6/1967 | Staring | 431/24 |
| 3,541,549 | 11/1970 | Graves | 431/24 |
| 3,554,680 | 1/1971 | Malavasi | 431/24 |
| 3,684,423 | 8/1972 | Bryant | 431/24 |
| 3,781,161 | 12/1973 | Schuss | 431/26 |
| 3,849,056 | 11/1974 | Schuss | 431/24 |

*Primary Examiner*—Carroll B. Dority, Jr.

[57] ABSTRACT

A burner control system in which signals indicating the condition at various locations within the system are applied to a control circuit in the form of pulse trains, causing a continuous alternation of state of solid state switching elements therein. The system actuates a switch to open a fuel valve only when the level of the control circuit output signal is alternating, indicating that the said switching elements are operative. A comparison circuit compares the control circuit output signal with a signal denoting the condition of the fuel valve, to ensure proper operation of the fuel valve switch.

14 Claims, 8 Drawing Figures

BURNER CONTROL SYSTEM

BACKGROUND

This invention relates to an improved burner control system, and more particularly to means for supervising the operation of elements in a control circuit for the system.

In order to ensure that a burner will be operated only in a safe environment, burner systems are normally provided with means to sense the condition at various locations in the system, and to feed an array of condition sensing signals to a control circuit. The burner fuel valve is opened to admit fuel into the combustion chamber only when the pattern of condition sensing signals indicates that it is safe to do so.

A dangerous situation can result if the control system does not function properly, the hazard being particularly severe if the control system fails to react when the burner flame goes out. In this event fuel will accumulate in the combustion chamber, creating the possibility of an explosion should ignition again be attempted. Checking for proper operation of the control circuit is therefore of considerable importance, particularly for the portion of the control circuit that processes a flame indication signal. Also, a failure of the fuel valve to respond properly to signals from the control circuit can lead to the same problems as those associated with a failure of the control circuit itself. If either the control circuit or the fuel valve actuating circuit does fail, it is desirable that they do so in a manner that will not result in fuel accumulating in the combustion chamber.

In recent years burner control technology has made advances in the use of solid state switching elements or computers for the principal portion of the control logic, in contrast with the high capacity relays traditionally employed. Although the new devices can be smaller and less expensive, relays have the advantage of a generally predictable failure mode, i.e., it is predictable whether the contacts will be conductive or open when failure occurs. This is particularly true when large safety factors are built in. With solid state switching devices, however, it is usually impossible to predict the state the device will be in at failure, and a satisfactory self-checking system must be able to respond to the failure of a switching element in either state.

SUMMARY

In accordance with the above, it is an object of this invention to provide a novel and improved burner control system that is self-checking, and that fails in a safe condition should a malfunction occur.

A more particular object of the invention is to provide a novel and improved burner control system that regularly alternates the state of solid state elements within the system to ensure that the alternated elements are operative.

Another object of the invention is the provision of a novel and improved burner control system in which an output control signal can be reliably checked against particular input condition sensing signals to ensure compatability therewith.

A further object of the invention is the provision of novel and improved means for checking the response of a fuel valve to an applied control signal.

In accordance with the invention there is provided, in conjunction with a burner control system having a fuel valve and a plurality of sensors adapted to sense the conditions at various locations in the system and to actuate signals denoting said conditions, a control circuit adapted to produce an output control signal in response to the condition sensing signals received at input terminal for control circuit. Solid state switching means are connected in circuit between the control circuit input terminal and an output terminal, with means provided to alternate the state of the switching means, and thereby the level of the control signal at the output terminal, in response to a particular condition sensing signal. The alternating means may include means for converting a condition sensing signal, preferably the signal denoting the condition of the burner flame, to a pulse train signal prior to its arrival at a control circuit input terminal. An actuating signal for the fuel valve is produced by a circuit at the control circuit output terminal in response to an alternating control signal at that terminal, but not otherwise. The signal at the output terminal is compared with the signal which denotes the condition of the fuel valve by a comparison circuit, which actuates a means for overriding a fuel valve actuating signal should the compared signals be incompatible.

In particular embodiments a control switch having normally closed contacts is connected in the valve actuation circuit to enable the fuel valve to be closed independently of the control signal or the comparison circuit output signal.

In one embodiment of the control circuitry, solid state means having first and second input terminals are connected with one terminal at the output of a logic signal circuit, the said means having a pulse train signal output when a pulse train signal is applied to one of its input terminals and a sustained DC signal to the other terminal. Means are provided to convert a condition sensing signal to a pulse train signal, and to apply the pulse train signal to the second solid state means input terminal. An actuating circuit produces an actuating signal for the fuel valve when a pulse train signal is present at the output of the solid state means, but not otherwise.

In this embodiment the fuel valve is not actuated unless a signal is presented to the solid state means from both the signal converting means, and from the logic circuit. Actuation of the fuel valve should the logic circuit output be inconsistent with the condition sensing signal from which the pulse train is derived thereby precluded.

In an alternate embodiment, specified condition sensing signals are converted to pulse train signals and applied directly to a logic circuit to alternate the state of solid state switching elements therein. If the alternated switching elements are operating correctly, a pulse train signal is produced at the logic circuit output for actuation of the fuel valve. In this embodiment several logic circuit elements used in conventional control schemes are modified for use within the pulsing system. Logical inverter elements are provided with output delay circuits to prevent the production of a logical "one" during the interval between successive pulses. Circuit elements such as flip-flops having a sustained DC output signal, even with a pulse train input, are modified, to give a pulse train output by the provision of an output gate that is conditioned by the said DC signal. A pulse train signal source provides a second input to the gate, the output of which is likewise a pulse train when the circuit element is set. Where a circuit element is designed to operate in response to a sustained DC input, a circuit consisting of a modified inverter and a second inverter is provided to convert an input pulse train signal to DC.

Various arrangements for the comparison circuit are possible. In one, the signals at the control circuit output terminal and at the fuel valve are converted to sustained DC signals prior to comparison. In another arrangement, the signal denoting the condition of the fuel valve only is so converted, producing a pulse train output from the comparison circuit under normal operating conditions. The said comparison circuit may be supervised by the provision of an additional circuit at its output that overrides the fuel valve actuating signal when a pulse train signal is absent from the comparison circuit output, but not otherwise. For gang control of a plurality of valves, a comparison circuit is provided for each valve, and their outputs supplied to a gate means. The overriding means is actuated should an actuating signal be present at the output of any of the actuating circuits therefor. The gate means is itself supervised for failure by the introduction of a pulse train signal input, and by the provision of a circuit for actuating the overriding means unless there is a corresponding pulse train signal at the gate means output.

The invention also contemplates the use of a standard AC power line in the conversion of various signals to pulse train signals, and employs for this purpose a circuit including a light emitting diode, means responsive to the presence of the unconverted signal for coupling the AC power line with the light emitting diode for periodic energization of the latter, a phototransistor optically coupled with the light emitting diode, and a one-shot multivibrator triggered by the output of the phototransistor to produce a pulse of shorter duration than the period of the AC signal.

Other objects, features, and advantages of the invention will be seen from the following description of preferred embodiments, in conjunction with the drawings, in which.

DETAILED DESCRIPTION OF PARTICULAR EMBODIMENTS

Figure 1:
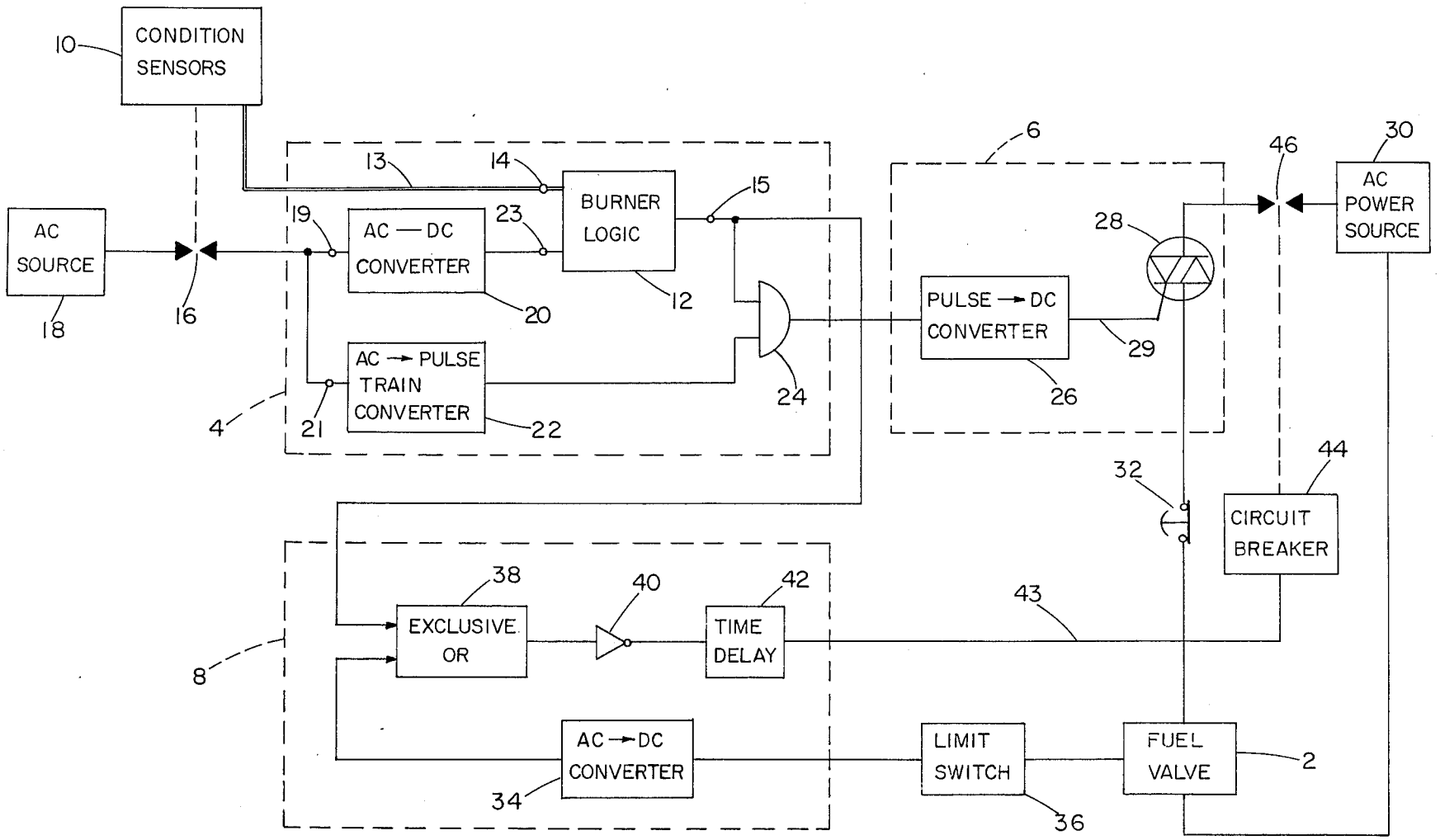
FIG. 1 is a combined block and schematic diagram of a burner control system constructed in accordance with the present invention.

Referring first to FIG. 1, there is shown one embodiment of a fail-safe self-checking circuit for controlling the operation of a fuel valve 2 in a burner system. Three principal subcircuits, shown enclosed in dashed lines, are a control circuit 4, a fuel valve actuating circuit 6 that operates in response to the output from control circuit 4, and a comparison circuit 8 to supervise the actuating circuit 6.

A plurality of condition sensing devices 10 are distributed throughout the burner system in a conventional manner to sense the condition of various system elements, such as the fuel valves, the medium to be heated, and the flame in the combustion chamber. Appropriate signals denoting the condition of these elements are produced by the sensing device 10 and transmitted over a plurality of lines to input terminals 14 associated with burner logic 12 in the control circuitry 4. For simplicity, the various signal lines are represented by a cable 13 in the drawing, and their associated logic circuit input terminals by terminal 14. The logic circuit 12, examples of the general type of such logic circuits being shown in U.S. Pat. Nos. 3,064,719; 3,433,572 and 3,684,423, for example, processes the condition sensing signals in a conventional manner, and produces a control signal at its output terminal 15 for actuating the fuel valve 2 through circuit 6 in response to a call for heat when the array of condition sensing signals indicates that it is safe to do so. In the Bryant Pat. No. 3,684,423, the logic shown in FIGS. 2–4 would work as the present burner logic 12. For example, the signals from 20-1, 20-2, 16-1 14-1, etc. in U.S. Pat. No. 3,684,423 are equivalent to the present signals on the lines at 23 and 14 in FIG. 1 and the signal at 280 in FIG. 4 of U.S. Pat. No. 3,684,423 is the equivalent of the signal at 15 in the present FIG. 1.

To ensure that the logic circuit 12 is not producing a false actuating signal, its output is tested for compatibility with a condition sensing input. While the comparison may be made with any combination of one or more of the condition sensing signals, the apparatus shown in FIG. 1 provides a check only with the critical flame indication signal. A set of normally open flame relay contacts 16, controlled by a flame sensor (not shown), are closed when flame is present in the combustion chamber, connecting an alternating current power source 18 (preferably a normal supply voltage line) to the input terminal 19 of an AC-to-DC converter 20 such as an incandescent lamp and photoresistor device. The AC signal is also connected to the input terminal 21 of a device 22, to be described in more detail hereinafter, for conversion into a pulse train signal. The sustained DC output of converter 20 is fed to another input terminal 23 to the logic circuit 12, the output of which is directed to a solid state AND gate 24. The output of convertor 22 is supplied as a second input to AND gate 24.

While an AC power source is employed to enable the convertor 22 to be operated from a standard AC power line, the type of power source is not critical so long as a sustained DC signal is provided to the logic circuit 12 and a pulse train signal is provided to the AND gate 24. Alternate power sources could be selected and appropriate conversion devices inserted in the control circuit 4 within the scope of the invention.

The fuel valve actuating circuit 6 includes a pulse train-to-DC signal convertor 26 having an input from the AND gate 24, and a switch such as triac 28 in the energizing path for the fuel valve 2. The signal convertor 26, described in detail hereinafter, supplies a gating signal to triac 28 over lead 29 in response to a pulse train signal at the output of AND gate 24 to complete an energizing circuit between the fuel valve 2 and an appropriate power source 30, through circuit breaker contacts 46 and normally closed Burner Off switch 32.

The comparison circuit 8 includes in this embodiment an AC-to-DC conversion device 34 connected to limit switch 36 associated with the fuel valve 2 for conversion of an AC signal at the limit switch, denoting that the fuel valve 2 is open, to a sustained DC signal. The output of the DC signal and the burner logic output signal are applied to exclusive OR circuit 38. Exclusive OR gate 38 is connected through an inverter 40 and a time delay mechanism 42 to provide a compare satisfactory signal on line 43 to energize circuit breaker 44 and close contacts 46 in the energizing circuit for the fuel valve 2. The fuel valve condition is thereby continuously monitored and compared with the signal supplied by the control circuit 4 to the fuel valve actuating circuit 6. The fuel valve energizing is interrupted by opening circuit breaker contacts 46 should one compare input signal indicate a closed state for the fuel 2 and the other compare input signal an open state. Time delay 42 is provided to compensate for delay in the response time of the fuel valve 2 and limits switch 36.

The AND gate 24 is conditioned by an actuating output from the burner logic 12 to transmit a pulse train signal from signal convertor 22 to open the fuel valve 2 only if a signal is present at the AC-to-pulse train signal convertor 22. Should the logic circuit 12 fail to respond to a loss of flame, the transmission of an actuating signal to the fuel valve is precluded by flame relay contacts 16 opening and terminating the signal applied to the signal convertor 22, which in turn stops transmitting a pulse train signal to AND gate 24. The pulse train-to-DC signal cconvertor 26 is thereby de-energized, causing triac 28 to open and the fuel valve 2 to close. A failure of the logic circuit 12 to produce an actuating signal when called for will similarly decondition the AND gate 24, leaving the fuel valve 2 in a safe closed position. Should the AND gate 24 itself fail, producing either a sustained signal or no signal rather than a pulse train signal, the pulse train-to-DC converter 26 will become de-energized, again opening triac 28. The solid state AND gate 24 being capable of rapid alternation by an applied pulse train signal for an extended period of time without harm, the system thus assumes a safe state with the fuel valve 2 closed in the event of a control circuit failure. In addition, the application of a pulse train to AND gate 24 continually alternates the state of that element when a condition sensing signal is present at signal convertor 22, thereby adding a self-checking feature to the system. Should the compare signal on line 43 disappear, circuit breaker 44 will open contacts 46 and cause fuel valve 2 to close. Also, operation of Burner Off switch 32 will deenergize valve 2.

Figure 2:
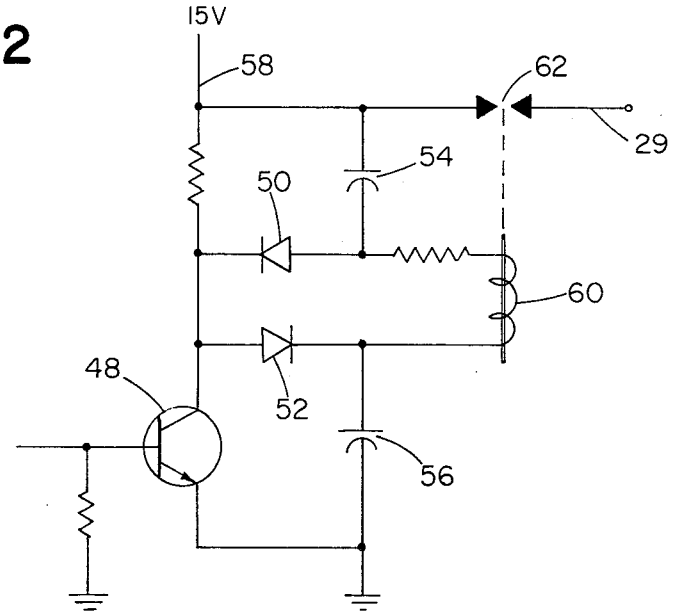
FIG. 2 is a schematic diagram of a pulse train-to-DC signal converting circuit.

A circuit that provides the pulse train-to-DC conversion function to signal convertor 26 is shown in FIG. 2, and includes a switching transistor 48 connected at its base to the output of AND gate 24, a pair of diodes 50 and 52 connected to the transistor collector in opposite directions of conduction, and a pair of energy storage devices such as capacitors 54 and 56 connected for alternate charging from a voltage source 58 and discharging through a load 60 as the collector-emitter circuit of transistor 48 is alternately completed and opened in response to a pulse train signal from AND gate 24. Load 60 in this particular embodiment comprises the coil of a relay that controls normally open contacts 62, situated in a path for the application of a gating signal to the triac 28. The relay coil 60 is energized only when a pulsed signal is supplied to the base of transistor 48 and that transistor is continuously alternated on and off; an unchanging signal at the transistor base results in steady state charges accumulating across the capacitors 54 and 56 and the termination of current flow through the relay coil 60.

Figure 3:
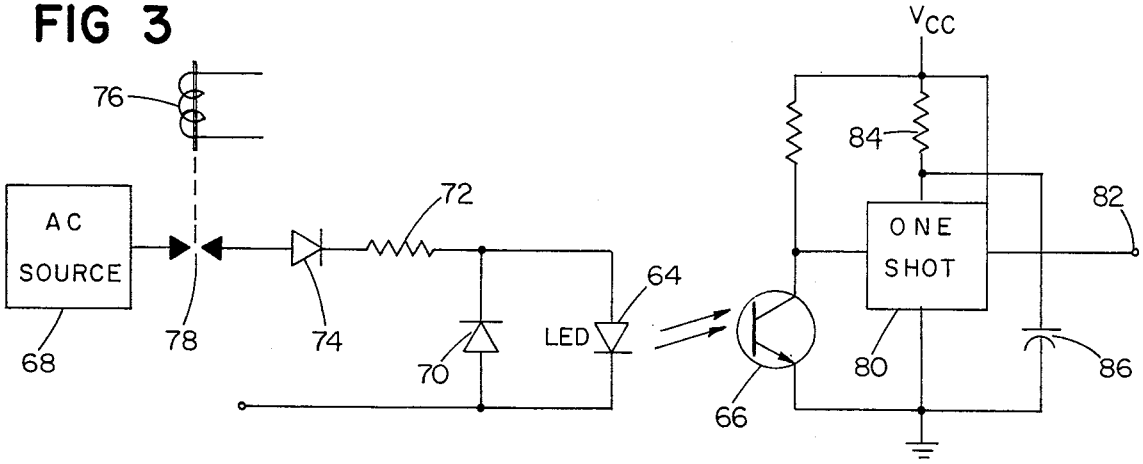
FIG. 3 is a schematic diagram of circuitry employed in the invention for converting a signal to a pulse train signal.

A suitable circuit for AC-to-pulse train signal convertor 22 is shown in FIG. 3, advantageously operating off of a normal 120 volt AC power line with a frequency of 60 Hz (50 Hz for European systems). A light emitting diode (LED) 64 is optically coupled with a phototransistor 66 to provide electrical isolation and voltage conversion from the AC source 68. A diode 70 is connected across the LED 64 in an opposite conductive sense thereto for protection of the LED during the reverse portion of the AC cycle. A resistor 72 and diode 74 are connected in series with LED 64 to respectively limit the current flow, and lower the circuit power requirements by preventing a current flow through the diode 70. The LED circuit also includes a device such as a relay 76 energized in response to the presence of a given condition sensing signal, and controlling a set of normally open contacts 78 connected between the AC source 68 and LED 64.

A one-shot multivibrator 80 is coupled to the emitter-collector output circuit of phototransistor 66 for triggering when the phototransistor is in a conducting state. The duration of the pulse produced at the one-shot output terminal 82 is determined by the characteristics of an RC circuit consisting of resistor 84 and capacitor 86 connected to the one-shot 80. The values of the RC elements are selected such that the one-shot pulse is of shorter duration than the period of the AC signal applied to the LED circuit, i.e., less than 16.7 milliseconds for a 60 Hz power source. The resistance value of resistor 72 is chosen such that the phototransistor 66 begins to conduct at a voltage sufficiently below the nominal 120 volt peak of the power source to allow for variations in the line voltage. This tolerance is especially important in applications such as power generating plants where large variations in the line voltage may be expected.

When relay contacts 78 are closed in response to the presence of the appropriate condition sensing signal (a flame signal is employed in the circuit of FIG. 1), the LED 64 is energized by power source 68 and produces an optical output to bring phototransistor 66 into conduction and trigger one-shot multivibrator 80. The pulse produced at the one-shot output terminal 82 terminates before the one-shot 80 is again triggered during the next cycle of AC power source 68. A cyclical pulse train signal results at terminal 82, the period of the pulse train cycle being equal to that of the AC power source 68. The duration of each pulse may be controlled by an appropriate selection of resistor 84 and capacitor 86 to produce a desired duty cycle within each period.

Figure 4:
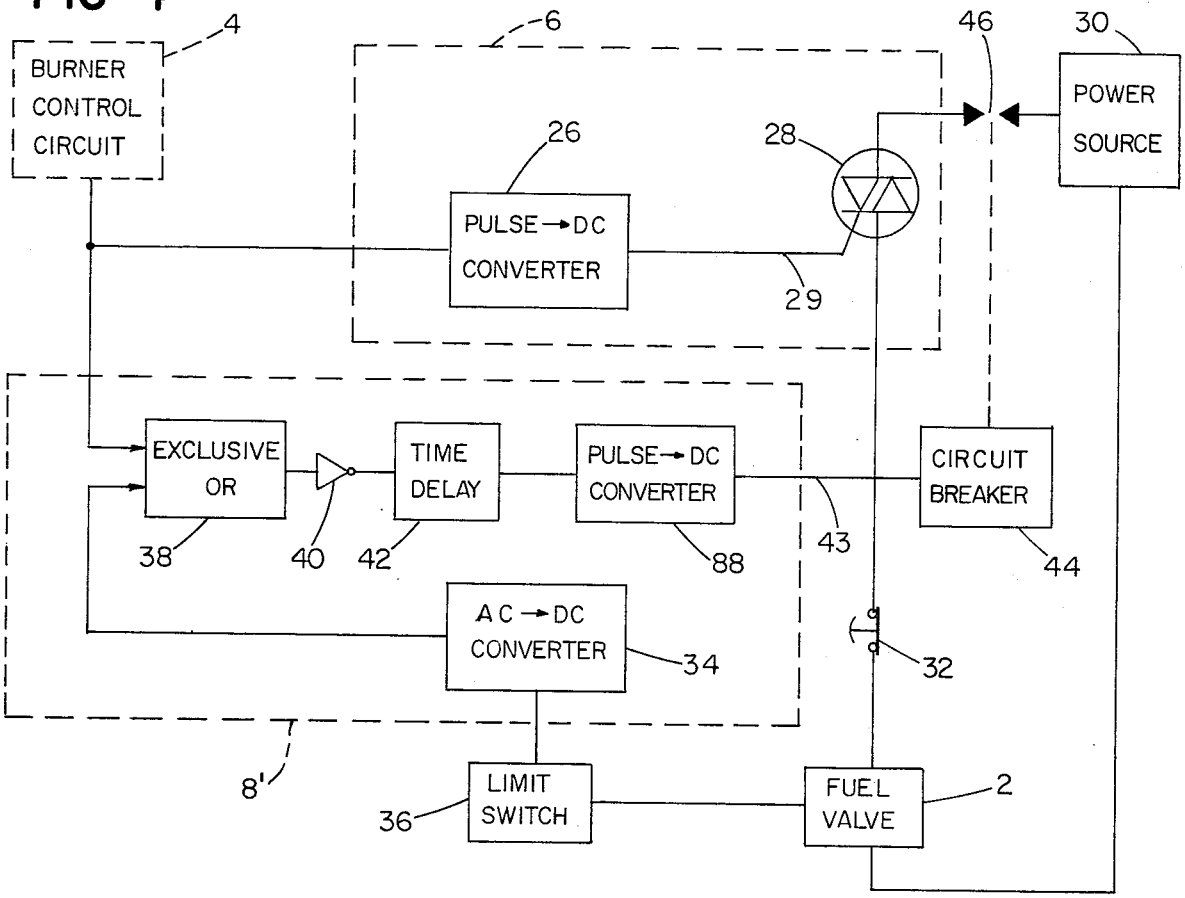
FIG. 4 is a combined block schematic diagram of another embodiment of a portion of the invention.

An alternate fuel valve actuating and comparison circuit is shown in FIG. 4. This alternate circuit has the additional advantage of a self-checking feature in the comparison circuit, designated 8'. Many of the circuit elements are the same as those in FIG. 1, and the numerals employed in that figure have been retained. The principal difference from the circuit of FIG. 1 lies in the addition of a pulse train-to-DC signal convertor 88 between time delay 42 and circuit breaker 44. The signal convertor 88 may conveniently be constructed according to the circuit of FIG. 2. In this embodiment a pulse train signal is supplied to the exclusive OR gate 38 directly from the output of the fuel valve circuitry 4 when actuation of the fuel valve 2 is called for, the other input to exclusive OR gate 38 being a sustained DC signal from AC-to-DC signal convertor 34 when the fuel valve 2 is actuated. Under these circumstances a pulse train signal is transmitted to the pulse train-to-DC signal converter 88, which supplies a sustained DC signal for energizing circuit breaker 44 and keeping breaker contacts 47 closed, completing the energising circuit for the fuel valve 2. The circuit breaker 44 opens contacts 46, de-energizing fuel valve 2, when convertor 88 fails to receive a pulse train signal. This may be due to either an incompatibility between the two signals fed into exclusive OR circuit 38, or to a failure in the comparison circuitry.

Figure 5:
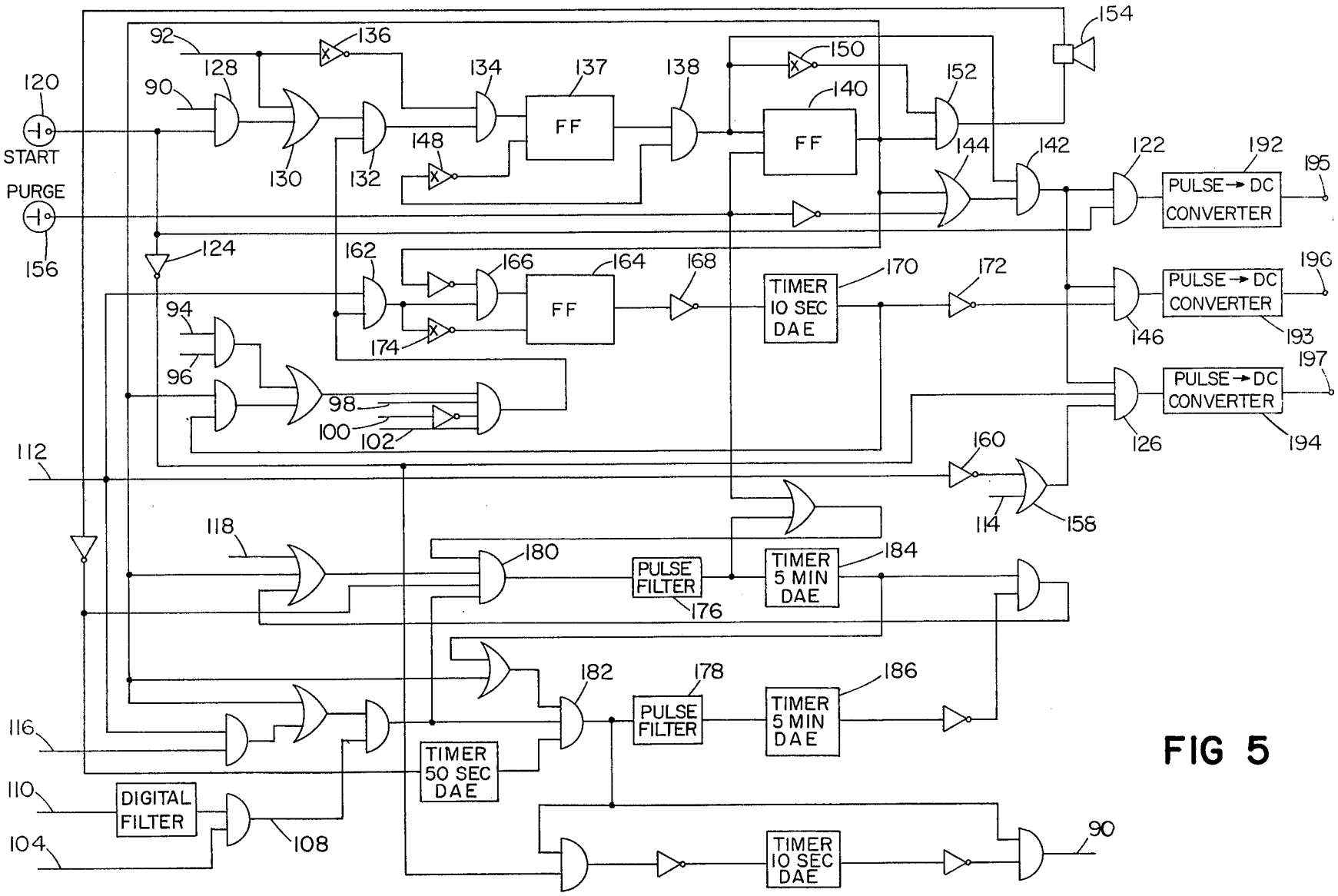
FIG. 5 is a schematic diagram of an alternate embodiment of a burner control circuit.

In an alternate embodiment for the control circuitry, shown in FIG. 5, a plurality of condition sensing signals are converted to pulse train signals and fed directly into a logic circuit to alternate the state of solid state switching elements therein by continually switching them on and off when burner operation is called for. A malfunction in the switching elements appears as a failure of the control circuit to produce a pulse train output. The control circuit is basically of conventional design to process a plurality of condition sensing signals and produce appropriate output signals, modified to be compatible with pulse train signal inputs.

The condition sensing signal inputs are designated in FIG. 5 as follows:

90 READY FOR IGNITION
92 FLAME ON
94 INITIAL BURNER AIR FLOW
96 INITIAL FUEL PRESSURE
98 FUEL PRESSURE-LOWER LIMIT
100 FUEL PRESSURE-UPPER LIMIT
102 BOILER READY
104 BOILER FUEL TRIP
110 MINIMUM AIR FLOW
112 FUEL VALVE CLOSED
114 FUEL COCK CLOSED
116 PILOT COCK CLOSED
118 PURGE AIR FLOW

Of these only input signals 92 and 104 arrive at the control circuit in the form of pulse train signals. A starter pushbutton 120 is provided to initiate the control sequence, and is connected to supply a gating signal directly to an AND gate 122 that controls the burner ignition transformer, and through inverter 124 to AND gate 126, the output of which controls the burner fuel valve. Starter pushbutton 120 is also connected to transmit a start signal through an AND gate 128 when a signal is present at the other input to the AND gate 128 indicating that the burner system is ready for ignition. The transmitted signal is passed through OR gate 130, which also conducts a signal 92 denoting the existence of a flame in the combustion chamber, to another AND gate 132. AND gate 132 is conditioned to pass the actuating signal when condition sensing signals 94, 96, 98, $\overline{100}$, and 102, respectively indicating safe states of the initial air flow in the burner, initial fuel pressure, upper and lower limits for the fuel pressure, and readiness of the boiler to be heated, are present (the initial air flow and fuel pressure indications no longer being necessary after the burner has been ignited). Of signals 94 through 102, only signal 102 (boiler readiness for heating) is a pulse train. Signal 108 is obtained when the boiler fuel trip signal 104 (boiler steam pressure, water level, and water limits switch), and minimum air flow signal 110 are safe for burner operation.

Figure 6:
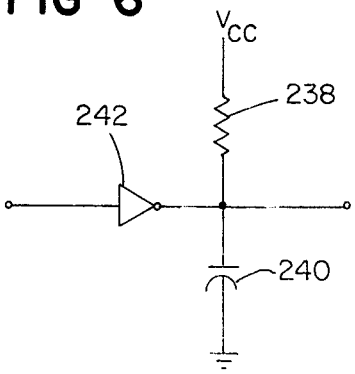
FIGS. 6 and 7 are schematic diagrams of circuit apparatus employed in the embodiment of FIG. 4.

A further AND gate 134 has a first input from AND gate 132 and a second input from the flame signal 92, inverted by logic inverter 136. To achieve a zero output from inverter 136 while a pulsed flame signal is present at its input, inverter 136 comprises the circuit shown in FIG. 6, in which a resistor 238 and capacitor 240 are connected at the output of a simple inverter 242 to prevent the production of a logical "one" during the interval between pulses in an input pulse train signal. Similar inverter circuits are encountered elsewhere in the circuit of FIG. 5, and are designated by asterisks. The output of AND gate 134 is connected to set a flip-flop circuit 137 when the system is ready for ignition, but no flame is yet present in the combustion chamber. An AND gate 138 has inputs from flip-flop 137 and AND gate 132, and is connected to set a second flip-flop 140 and provide a gating signal to an AND gate 142. The output of flip-flop 140 is applied through an OR gate 144 to the other input of AND gate 142, which is thereby conditioned to transmit a pulse train signal at the output of AND gate 138 to the AND gates 122, 126, and 146 associated with the burner valves and ignition transformer.

The output of AND gate 132 is applied through inverter 148 to reset flip-flop 137 if either the start button 120 is released before flame is established, or if the flame goes out. Another inverter 150 is connected between the output of AND gate 138 and the input of an AND gate 152, with the output of flip-flop 140 connected to a second input to AND gate 152. A signal is produced at the output of AND gate 152 upon loss of flame to energize an alarm such as horn 154. The flip-flop 140 is reset by a pushbutton 156 for initiating a purge cycle, the inverted output of which is also supplied to an input to OR gate 144.

The final input to AND gate 126 is suplied by an OR gate 158, which has as a first input a signal (112) indicating a closed state for the main fuel valve, inverted by an invertor 160, and as a second input a signal (114) indicating a closed state for a manually operable fuel cock. The AND gate 146 associated with the pilot valve has a second input that provides a ten second interval after the main fuel valve is opened before de-conditioning the AND gate 146 and thereby closing the pilot valve. The said circuit includes an AND gate 162 which has as inputs the signal (112) indicating a closed state for the fuel valve and a signal from sensors 94 through 102, a flip-flop 164, an AND gate 166 having as a first input the output of AND gate 162 and as a second input the inverted output of flip-flop 140, and inverter 168, timer circuit 170, and inverter 172 connected in series between flip-flop 164 and AND gate 146. An invertor 174 has an input from AND gate 162 and is connected to reset the flip-flop 164 and thereby initiate the timing cycle of timer circuit 170 when the main fuel valve is opened. At end of that timing cycle, the pilot valve closes.

Figure 7:
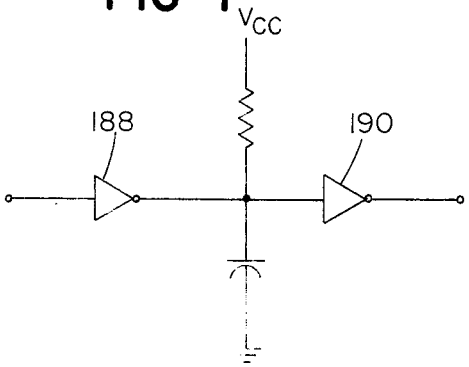

Except for two pulse train filters 176 and 178, the remainder of the logic circuit, which includes inputs for signals sensing the condition of the pilot cock (116) and the air-flow during the purge period (118), is conventional. The two pulse train filters 176 and 178 convert pulse train signals at the outputs of AND gates 180 and 182, respectively, to sustained DC signals for application to a pair of timer circuits 184 and 186 employed in the purge cycle. A suitable circuit for the pulse train filters is shown in FIG. 7, and includes an inverter 188, an output RC circuit to maintain a logical "zero" when a pulse train signal is applied to the inverter 188 (this portion of the circuit is identical to the logical inverter shown in FIG. 6), and a second inverter 190 having a sustained DC output when the input to inverter 188 is a pulse train signal.

In the embodiment of FIG. 5, each of the solid state switching elements to which a pulse train signal is applied is continually alternated in state by being switched on and off during each cycle of the pulse signal. With all the elements functioning properly, pulse train signals are supplied to the pulse train-to-DC signal converters 192, 193, and 194, which employ the circuit previously described in conjunction with FIG. 3 to produce actuating signals at their respective output leads 195, 196, and 197 for various burner devices, such as an ignition transformer, pilot fuel valve, and the previously mentioned main fuel valve. A malfunctioning switching element that fails to alternate properly will result in either a sustained DC signal or zero signal being applied to signal converters 192, 193, and 194. In either case, said signal converters will not produce an actuating output, and the burner will shut down safely.

While only certain specified condition sensing signals have been described as being in pulse train form, it should be understood that other sets of condition sensing signals may be in such form, depending upon the control circuit switching elements for which a self-checking feature is desired. While it is preferable that only one input to a switching element be pulsed, economic or design considerations may favor more than one input being in such form. This can be done without losing the self-checking benefits of the invention, so long as the pulsed inputs are not so out of phase as to prevent the achievement of an effective pulse train output from the switching element.

Figure 8:
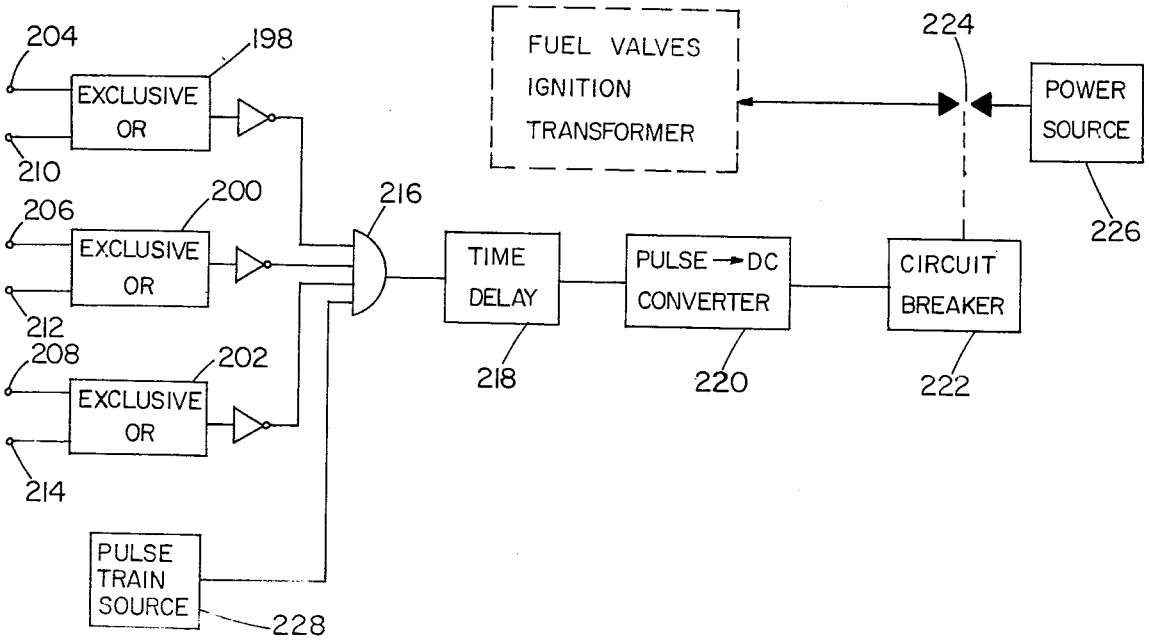
FIG. 8 is a block diagram of a portion of the burner control system adapted for use with a plurality of fuel valves.

Referring now to FIG. 8, a comparison circuit is shown that is designed for use with a control circuit such as the one described in connection with FIG. 1, in which pulse train signals are employed in the actuation of a plurality of burner devices. Exclusive OR gates 198, 200, and 202 have first input leads 204, 206, and 208 connected for reception of control signals for pilot, gas, and oil valves, respectively, and second input leads 210, 212, and 214 connected to receive signals denoting the condition of the controlled burner devices. Two input signals are compared by each exclusive OR inverter circuit, which produce signals to actuate a means to override a burner device actuating signal when the compared signals are incompatible. In this respect each exclusive OR gate performs the same function as when only one fuel valve is being controlled.

The outputs of exclusive OR gates are supplied to an AND gate 216. Following the AND gate 216 in succession are a time delay circuit 218, a pulse train-to-DC signal converter 220, and a circuit breaker 222 with normally open contacts 224 controlling the completion of a circuit between the said burner devices and a power source 226, for actuating said devices. A pulse train signal source 228 provides a further input to AND gate 216. This latter signal in necessary for the output from AND gate 216 to be a pulse train signal. With this circuit, actuation of all the controlled burner devices is overriden in the event of an incompatibility between the command and condition signals.

While particular embodiments of the invention have been shown and described, various modifications thereof will be apparent to those skilled in the art. It is therefore not intended that the invention be limited to the disclosed embodiments or to details thereof, and departures may be made therefrom within the spirit and scope of the invention as defined in the claims.

What is claimed is:

1. In a burner control system having a fuel control device, and a sensor adapted to sense a condition in the system and to provide a signal denoting said condition, the improvement comprising a fail-safe, self-checking system for controlling said fuel control device, comprising:

a control circuit, said control circuit having an input terminal for reception of said condition signal, logic for processing said condition signal, an output terminal, and solid state switching means connected in circuit between said input terminal and said output terminal, said control circuit adapted to produce a control signal at said output terminal in response to the condition signal at said input terminal, means for cyclically alternating the state of said switching means, and thereby providing a cyclically alternating level of the control signal at said output terminal in response to said condition signal, an actuating circuit connected between said output terminal and the actuator of said fuel control device, and adapted to provide an actuating signal for said fuel control device in response to a cyclically aalternating control signal level at said output terminal, but not otherwise, a comparison circuit to compare the output signal of said condition signal processing logic with a signal denoting the condition of said fuel control device, and means actuated by said comparison circuit when the said compared signals are incompatible to override said actuating signal for said fuel control device.

2. The burner control system of claim 1 and further including a directly operable switch having normally closed contacts connected in series with said control device actuator for closing said control device when said contacts are opened.

3. The burner control system of claim 1, wherein said means for alternating the switching means state includes means for converting a condition signal to a pulse train signal prior to its application to said switching means.

4. The burner control system of claim 3, wherein said control device is a fuel valve and said signal converting means is connected to convert a signal denoting the condition of the burner flame.

5. The burner control system of claim 3, wherein said signal converting means includes an AC signal source, a light emitting diode, means responsive to the presence of said condition signal for coupling said AC signal source to said light emitting diode for periodic energization thereof, a phototransistor optically coupled with said light emitting diode, and a one-shot multivibrator periodically triggered by the output of said phototransistor to produce a pulse train signal.

6. The burner control system of claim 1, wherein said comparison circuit includes means to convert a signal denoting the condition of said control device to a sustained DC signal, and is adapted to compare the said converted signal with the signal at the control circuit output terminal for compatibility therewith.

7. The burner control system of claim 1, wherein said comparison circuit is adapted to produce an output pulse train signal when the said compared signals are compatible with an actuated state for said control device, and including pulse train signal responsive means having an input connected to the output of said comparison circuit, and an output connected to said overriding means, said last-named means being actuated by said pulse train responsive means during the absence of a pulse train signal at the input thereto.

8. The burner control system of claim 7 and further including a directly operable switch having normally closed contacts connected in series with an actuator for said control device for de-energizing said control device when said contacts are opened.

9. In a burner control system having a fuel control device, a plurality of sensors adapted to sense the condition at various locations in the system and to provide steady state signals denoting said conditions, and a logic control circuit connected to receive condition signals, and adapted to produce a steady state fuel control signal in response to a predetermined combination of said condition signals, the improvement comprising a fail-safe, self-checking system for controlling said fuel control device, comprising:

solid state means having an output terminal and first and second input terminals, the first input terminal being connected to receive said steady state fuel control signal from the logic control circuit, said solid state means producing a pulse train signal output when a pulse train signal is applied to one of said input terminals and a sustained DC signal is applied to the other of said input terminals, means for producing a pulse train signal in response to one of said condition signals, said pulse train signal producing means being connected to apply said pulse train signal to the second input terminal of said solid state means, and circuit means connected between the output terminal of said solid state means and said fuel control device, and adapted to provide an actuating signal for said fuel control device in response to a pulse train signal at said solid state means output terminal, but not otherwise.

10. The burner control system of claim 9, wherein said means for producing a pulse train signal in response to one of said condition signals means is connected to convert a signal denoting the condition of the burner flame and said control device is a fuel valve.

11. The burner control system of claim 9 wherein said means for producing a pulse train signal in response to one of said condition signals is responsive to an AC signal of power frequency and said pulse train signal has a repetition rate corresponding to said power frequency.

12. In a burner control system having a fuel valve, a switch means operable to complete an energizing path to said fuel valve, and a control circuit adapted to produce a pulse train signal to operate said switch means in response to the conditions at various locations in the system, the improvement comprising:

means to override an actuating signal for said fuel valve, an actuating circuit for said overriding means, said actuating circuit including means to sense a fuel valve control signal produced by said control circuit and a fuel valve condition signal, said actuating circuit adapted to produce an actuating signal for said overriding means to close said fuel valve whenever said sensed signals are not in proper agreement.

13. The burner control system of claim 12 and further including a directly operable switch having normally closed contacts connected in series with said fuel valve for closing said fuel valve when said contacts are opened.

14. The burner control circuit of claim 13, adapted for use with a plurality of valves, each of said valves having an associated control circuit and overriding means actuating circuit, said overriding means being adapted when not supplied with a pulse train signal to override the actuating signal for each of said valves, and further including a gate means connected between said overriding means and the actuating circuits therefor, means to apply a pulse train signal as an input to said gate means, said gate means being conditioned to transmit an input pulse train signal only during the absence of an actuating signal at the outputs of each of said overriding means actuating circuits.

* * * * *

UNITED STATES PATENT AND TRADEMARK OFFICE

CERTIFICATE OF CORRECTION

PATENT NO. : 3,954,383

DATED : May 4, 1976

INVENTOR(S) : Jack A. Bryant

It is certified that error appears in the above-identified patent and that said Letters Patent are hereby corrected as shown below:

Column 2, line 47, after "derived", insert --is--;
line 63, after "modified", delete the comma.
Column 4, line 7, "device" should be --devices--.
Column 5, line 18, before "2" insert --valve--;
line 55, "to" should be --of--.
Column 7, line 10, "47" should be --46--;
line 10, "energising" should be --energizing--.
Column 8, line 39, "suplied" should be --supplied--;
line 62, after "logic", insert --control--.
Column 9, line 64, "in" should be --is--.
Column 10, line 32, "aalternating" should be --alternating--.
Column 12, line 5, delete "means".

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*